US007578009B1

(12) United States Patent
Boston

(10) Patent No.: US 7,578,009 B1
(45) Date of Patent: Aug. 25, 2009

(54) ATHLETIC HAMMOCK

(76) Inventor: James Lloyd Boston, P.O. Box 22, Shalimar, FL (US) 32579

( * ) Notice: Subject to any disclaimer, the term of this patent is extended or adjusted under 35 U.S.C. 154(b) by 0 days.

(21) Appl. No.: 11/904,818

(22) Filed: Sep. 28, 2007

Related U.S. Application Data

(63) Continuation-in-part of application No. 11/164,955, filed on Dec. 12, 2005, now abandoned.

(51) Int. Cl.
*A41B 9/02* (2006.01)

(52) U.S. Cl. ..... 2/405; 2/403; 2/400; 2/238

(58) Field of Classification Search ..... 2/400–405, 2/227, 238, 228; 604/386–400; 602/67–72
See application file for complete search history.

(56) References Cited

U.S. PATENT DOCUMENTS 2,058,970 A * 10/1936 Fiesh ..... 602/67
4,554,685 A * 11/1985 Ray ..... 2/403
5,647,065 A * 7/1997 Richerson ..... 2/403
6,901,607 B1 * 6/2005 Elwell ..... 2/403
7,065,797 B1 * 6/2006 Chen ..... 2/400
7,178,174 B2 * 2/2007 Soderstrom ..... 2/403

* cited by examiner

*Primary Examiner*—Gloria Hale
(74) *Attorney, Agent, or Firm*—Peter Loffler

(57) ABSTRACT

A pair of men s shorts, including under shorts, has a typical chassis with an abdomen opening, a right pant leg and a left pant leg. The user's genitals pass through an opening on the front of the chassis whenever the shorts are being worn. A hammock overlies the opening and is anchored to the chassis at two points on the right out seam, one point below the other, and two points on the left out seam, symmetrical with the right out seam attachment. The hammock is also attached to the chassis at the waist band and at the lower edge of the opening just above the left and right inseam joinder area. The hammock by being anchored at the out seams and being non-stretching in a transverse direction, acts as a sling in supporting the genitals of the user.

20 Claims, 4 Drawing Sheets

ATHLETIC HAMMOCK

This application is a continuation-in-part of U.S. patent application Ser. No. 11/164,955 filed on Dec. 12, 2005, now abandoned which is incorporated herein by reference in its entirety.

BACKGROUND OF THE INVENTION

1. Field of the Invention

The present invention relates to a pair of men's shorts wherein a hammock is used to provide support for the genitals of the wearer.

2. Background of the Prior Art

Traditional athletic supporters have as their chief objective the "support" of a man's genitals by holding them tightly against the body, minimizing movement while locating the genitals above their naturally occurring placement. U.S. Pat. No. 2,454,507 to Flaherty, U.S. Pat. No. 3,449,442 to Steinmetz, and U.S. Pat. No. 3,504,671 to Nelkin all demonstrate variations of this concept. The success of this traditional support design is the rational for the present invention as the former supports systems are unsuitable for extended wear and are generally uncomfortable.

Alternatively, modern stretch fabrics have allowed for construction of form fitting garments wherein the man's genitals are enclosed in a form fitting pouch created by a stretch of this type fabric across the groin area. Though not as constricting as the traditional approach, this manifestation does not provide much support. U.S. Pat. No. 4,173,976 to Bloomquist, et al., U.S. Pat. No. 5,131,100 to Atwater et al., U.S. Pat. No. 6,023,789 to Wilson, et al., U.S. Pat. No. 6,041,441 to Counts, et al., are variations embodying this concept. While seated, these designs provide no support to the wearer, who, after standing, must indelicately reposition his genitals or rely on gravity to do the job, the effects of gravity being impeded by the nature of the garment.

Another purpose of these types of garments is to create a system by which to install a protective cup device. This purpose is sometimes contained within one of the two aforementioned constructions. U.S. Pat. No. 4,811,427 to Regan, U.S. Pat. No. 5,819,323 to Edenfield, U.S. Pat. No. 5,920,914 to Dempsey, and U.S. Pat. No. 6,041,441 to Counts, et al., all include this approach. The very nature of the use of a cup encroaches on the comfort of the wearer.

Other devices are contoured anatomically such as U.S. Pat. No. 6,061,840 to Alligator, or use a string or strap as a design element such as U.S. Pat. No. 6,245,036 to McRoberts, et al. Such devices differ from the instant invention in each regard.

Still other men's active wear claim a totally natural positioning of the genitals. U.S. Pat. No. 6,243,880 to Lydenm, and U.S. Pat. No. 6,289,520 to Page each include this approach. These devices differ from the present invention in that they provide no support at all.

The inventions disclosed in U.S. Pat. Nos. 5,875,495 and 4,759,355 each to Thrower contain a common element in that an opening through which the genitals are placed is specified. The similarity ends as the shape of the opening differs, the nature of the brief differs, and most critically, the support offered in the cited designs are different from the present invention.

No other garment provides the support offered by the instant invention through the use of a hammock which lifts without crush. The athletic hammock provides variable, comfortable positioning of the genitals depending on the stance of the wearer.

SUMMARY OF THE INVENTION

The athletic hammock of the present invention is a garment that has the characteristic of supporting the male genitals in a cradle created by a suspension of cloth which does not pull towards the abdomen, but rather is itself supported by anchoring points at the waistline at the maximum width of the torso. This forms a sling-like platform which functions much like a hammock stretched between two trees with the wearer's genitals resting on the hammock.

The structure necessary to support the hammock is a form-fitting athletic short chassis of the style typically known as a trunk, compression short, or bicycle short, with certain modifications to support the improvement of the invention. The short's chief characteristic being that they are composed of cloth which has elastic properties and are constructed so as to tightly conform to the shape of the wearer around the top of his legs and his lower waist. This design makes the shorts less prone to twisting and provides a stable structure (or chassis) on which to attach the hammock element of the garment. The chief difference in the athletic hammock's construction from the usual form being that the present invention has an opening in the front which begins at a point between the legs of the wearer just aft of the scrotum and extends up to a point adjacent to the top of the pubic bone. This opening has an inelastic reinforced basting which is sewn around its perimeter to make the size and shape of the opening constant or nearly so. Obviously, the wearer's genitals would simply hang exposed if not for the addition of the hammock or some other modesty enhancing element.

The athletic hammock is comprised of a fabric which, though soft and comfortable, has little stretch capability in the transverse direction (the direction which is generally parallel with that of the waistband). The hammock portion is somewhat banana-leaf in shape and is secured to the bottom of the opening of the chassis (adjacent to the posterior of the scrotum) with an inelastic stitch technique. From the top of each side opening, the hammock is attached to the remainder of the shorts on a line roughly following the natural joining of the leg and torso, to a point at the outside top of the hipbone. The width of the hammock (anterior to posterior) at its lowest point is sufficient to establish a platform. The forward edge of this platform is held approximately horizontal while the wearer stands. This is due to the hammock's non-stretch bias being oriented on line with the anchor points. The end result is that it acts as a cable in tension, supporting the platform on which the genitals rest. The placement of anchor points for this support cable below the anchor points for the posterior edge ensures the cable is held forward by the bulk of the wearer's legs. The genitals are cradled in this created sling, the forward edge of which is in tension, anchored at only two points (on the body centerline below the waist). From this forward edge the hammock fabric wraps up, forming a pouch, and is secured at the elastic waistline of the chassis with a stitch technique allowing for the stretch of the waistband. Attachment at the waistline requires darts, pleats, an asymmetrically weaved cloth, or a similar manufacturing technique to prevent undesirable bunching of the excess materiel thereat. As the wearer raises his legs or spreads his legs, the hammock assembly is pulled forward and/or up due to the anchor points moving farther apart. The inelastic bias of the hammock prevents excessive stretching, thereby ensuring the cable-like action which pulls on and displaces the platform in concert with the leg movement. By lowering the terminus of the hammock from the waistline, the effect of the action of the leg movement on the hammock can be modulated. The larger the wearer's legs, the farther the forward edge of the hammock is pulled. It is by ensuring the cloth used for the hammock is cut to such a width and anchored appropriately (meaning that the lowest point of the V-shaped line from hip-to body centerline-to hip does not fall below the bottom of the opening in the chassis), that the full realization of the hammock effect is achieved. When the wearer is seated, the hammock passes from the outside of the leg, across the top of the leg, under the genitals, back across the top of the opposite leg to its anchor point on the opposite side. This supports the genitals and prevents them from falling between the wearer's legs.

The wearer dons the garment like any other sport short/athletic supporter and adjusts his genitals through the opening in the chassis and into the hammock. Access for bathroom breaks is "over the top." Alternatively, the hammock could be constructed with a traditional fly allowing for necessary access.

The athletic hammock is comprised of a typical shorts chassis that has a front panel and a rear panel joined to the front panel at a right out seam and an opposing left out seam. The chassis has an upper opening that encompasses a user's torso. The chassis has a right pant leg that has a right lower opening opposite the upper opening for receiving the user's right leg and a left pant leg that has a left lower opening opposite the upper opening for receiving the user's left leg. The right pant leg has a right inseam opposite the right out seam while the left pant leg has a left inseam opposite the left out seam. The right inseam and the left inseam join at a joinder. The front panel has a panel opening through which the user's genitals pass. A waist band encompasses the upper opening. A hammock is attached to the chassis in overlying relationship with the panel opening. The hammock has an upper edge attached to the waist band, a first right point attached to the right out seam below the waist band, a second right point attached to the right out seam below the first right point, a first left point attached to the left out seam below the waist band, a second left point attached to the left out seam below the first left point, and a bottom attached to the front panel at a lower edge of the opening. The first right point and the first left point are each located equidistant from the waist band and similarly the second right point and the second left point are each located equidistant from the waist band. The hammock has a non-stretch bias in the transverse direction (between first and second right points and first and second left points) and has a stretch bias in a direction that is perpendicular to the transverse direction. The chassis is formed from a stretch material. The hammock is made from any appropriate cotton blend which includes pure cotton or other appropriate material. An inelastic reinforced basting is located around an outer periphery of the panel opening. The waist band is elastic. The top edge of the hammock has non-bunching means thereat. The non-bunching means may consist of an asymmetrical weave, darting, and pleating. The bottom of the hammock has non-bunching means thereat. This non-bunching means may also consist of an asymmetrical weave, darting, and pleating.

BRIEF DESCRIPTION OF THE DRAWINGS

Similar reference numerals refer to similar parts throughout the several views of the drawings.

DESCRIPTION OF THE PREFERRED EMBODIMENT

Figure 1:
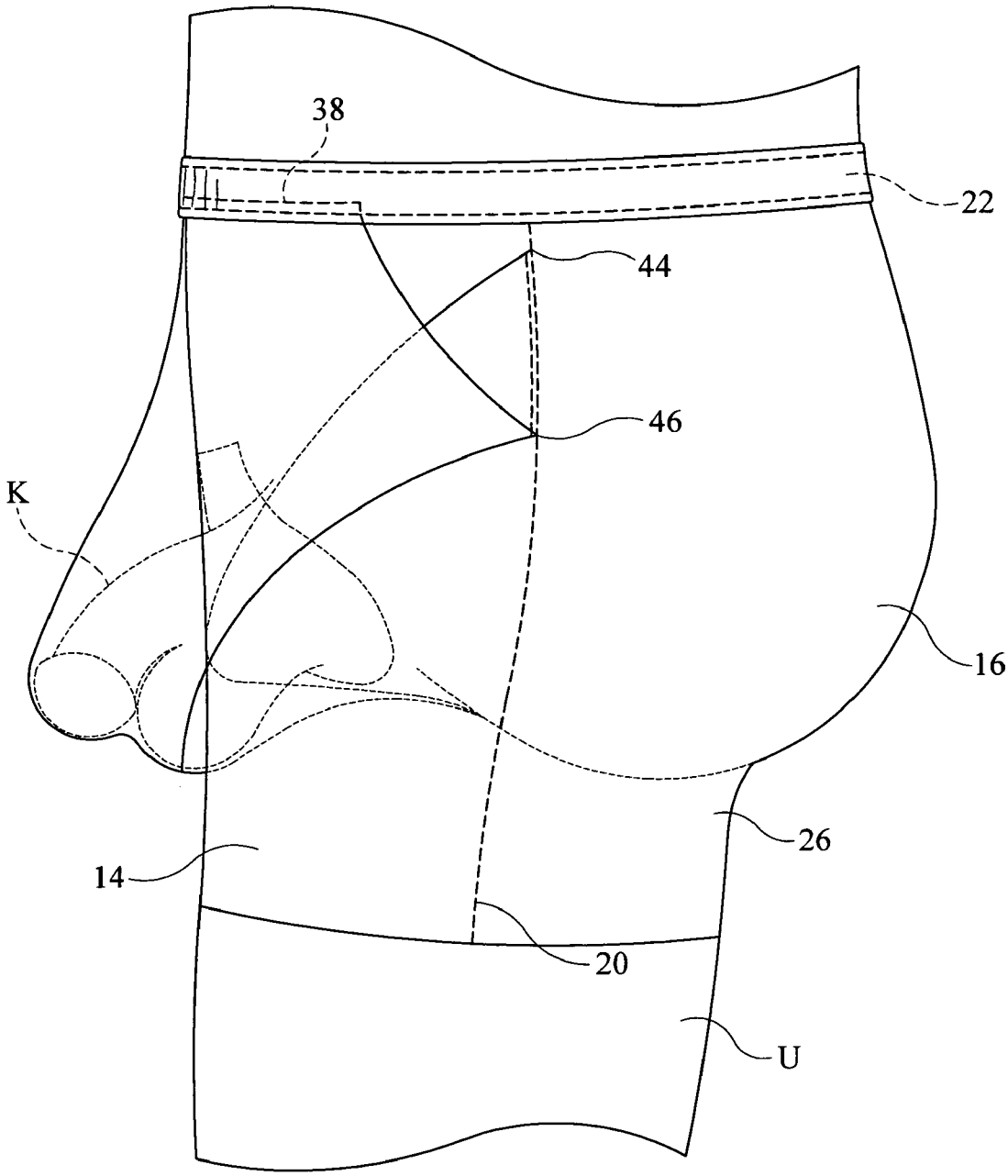
FIG. 1 is a side elevation view of the athletic hammock of the present invention being worn by a user in a standing position.
Figure 2:
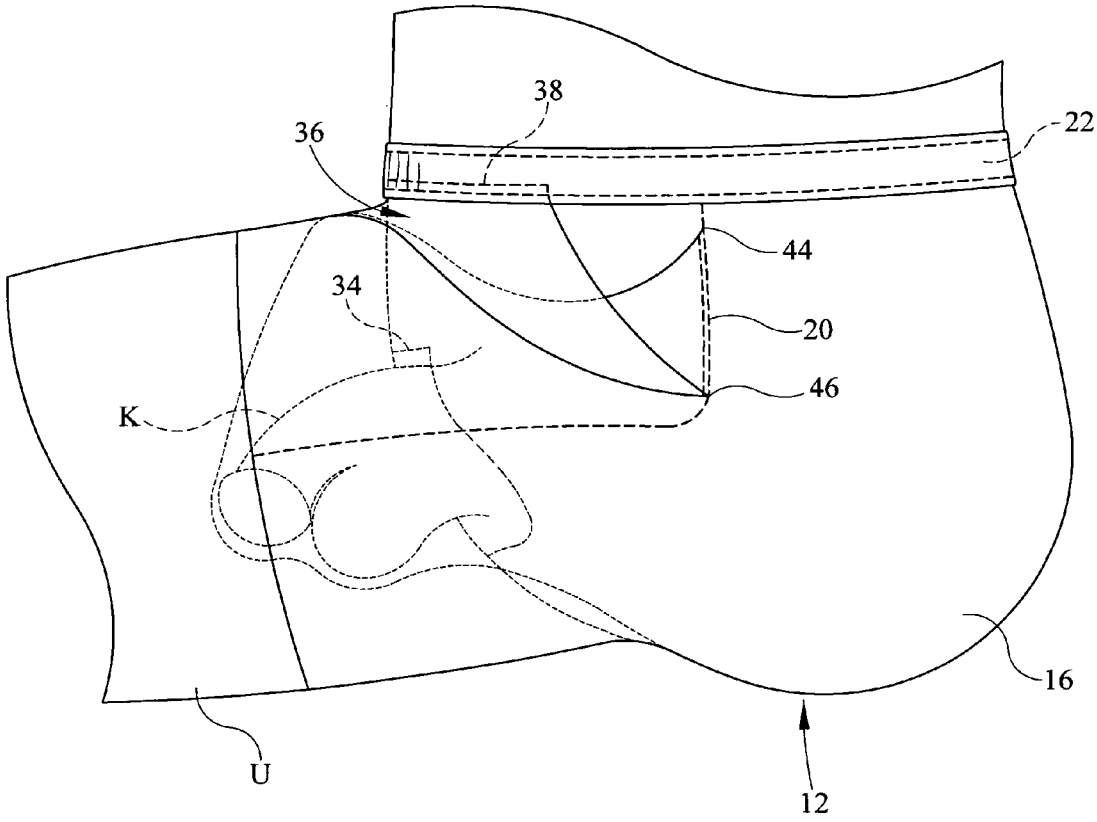
FIG. 2 is a side elevation view of the athletic hammock being worn by the user in a seated position.
Figure 3:
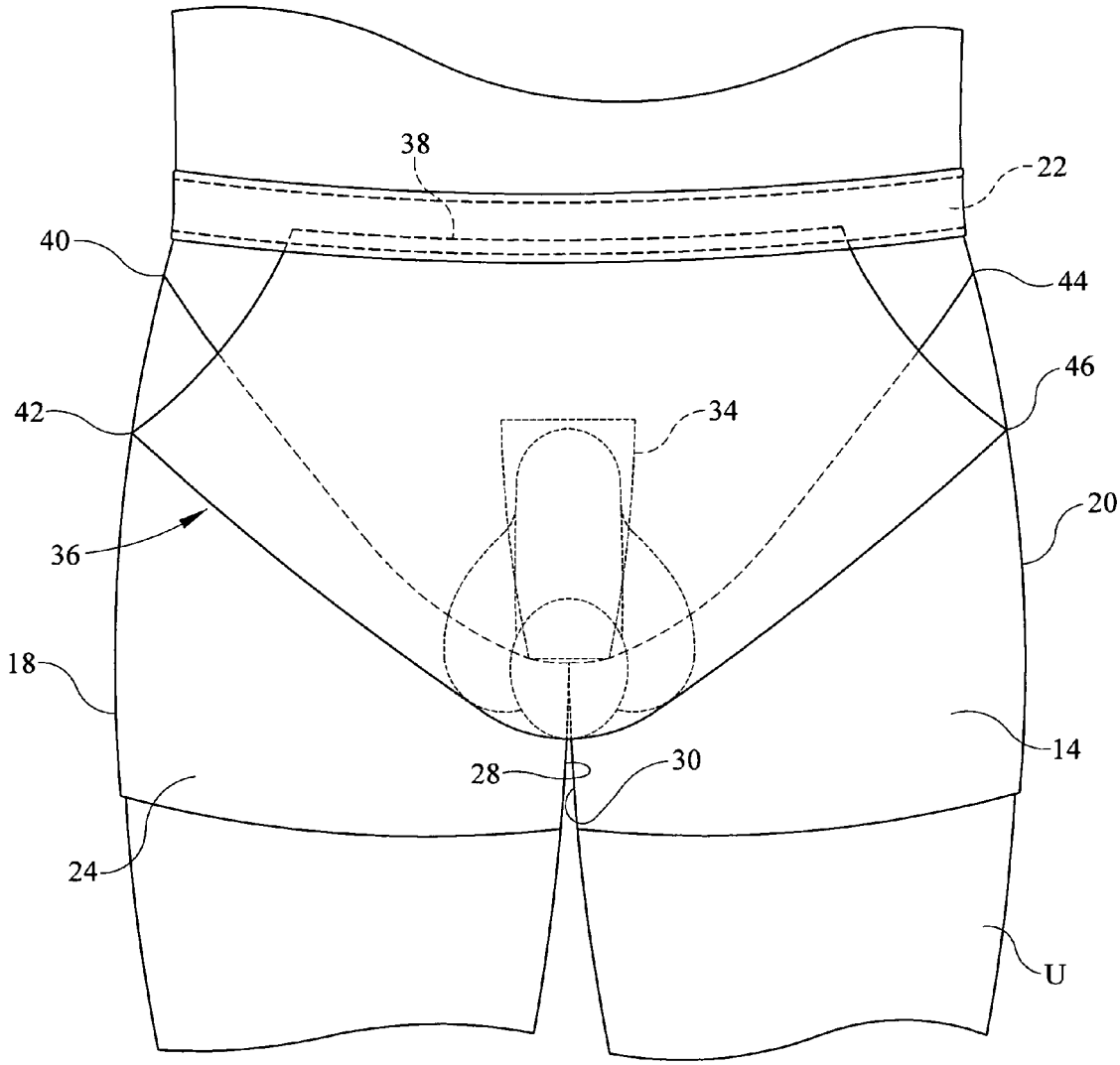
FIG. 3 is a front elevation view of the athletic hammock being worn by a user in the standing position.

Referring now to the drawings, it is seen that the athletic hammock of the present invention, generally denoted by reference numeral 10, is comprised of a typical pair of men's shorts chassis 12 that has a front main panel 14 and a rear main panel 16, the two panels 14 and 16 being joined at a right out seam 18 and a left out seam 20 by appropriate stitching as is well known in the art. A waist band 22 encompasses the single open top of the chassis 12 and is, advantageously elastic in nature. At the lower portion of the chassis 12 is right pant leg 24 and a left pant leg 26, the right pant leg 24 having a right inseam 28 whereat the front panel 14 is stitchedly joined to the rear panel 16, the left pant leg 26 having a left inseam 30 whereat the front panel 14 is also stitchedly joined to the rear panel 16. The right inseam 28 and the left inseam 30 meet at a joinder area 32 which may be a small point, as illustrated, or may be a bridge of up to a couple of inches in length, depending on the particular design of the chassis 12.

The front panel 14 and the rear panel 16 may each be of monolithic design or may be formed from various smaller panels stitched together.

Figure 4:
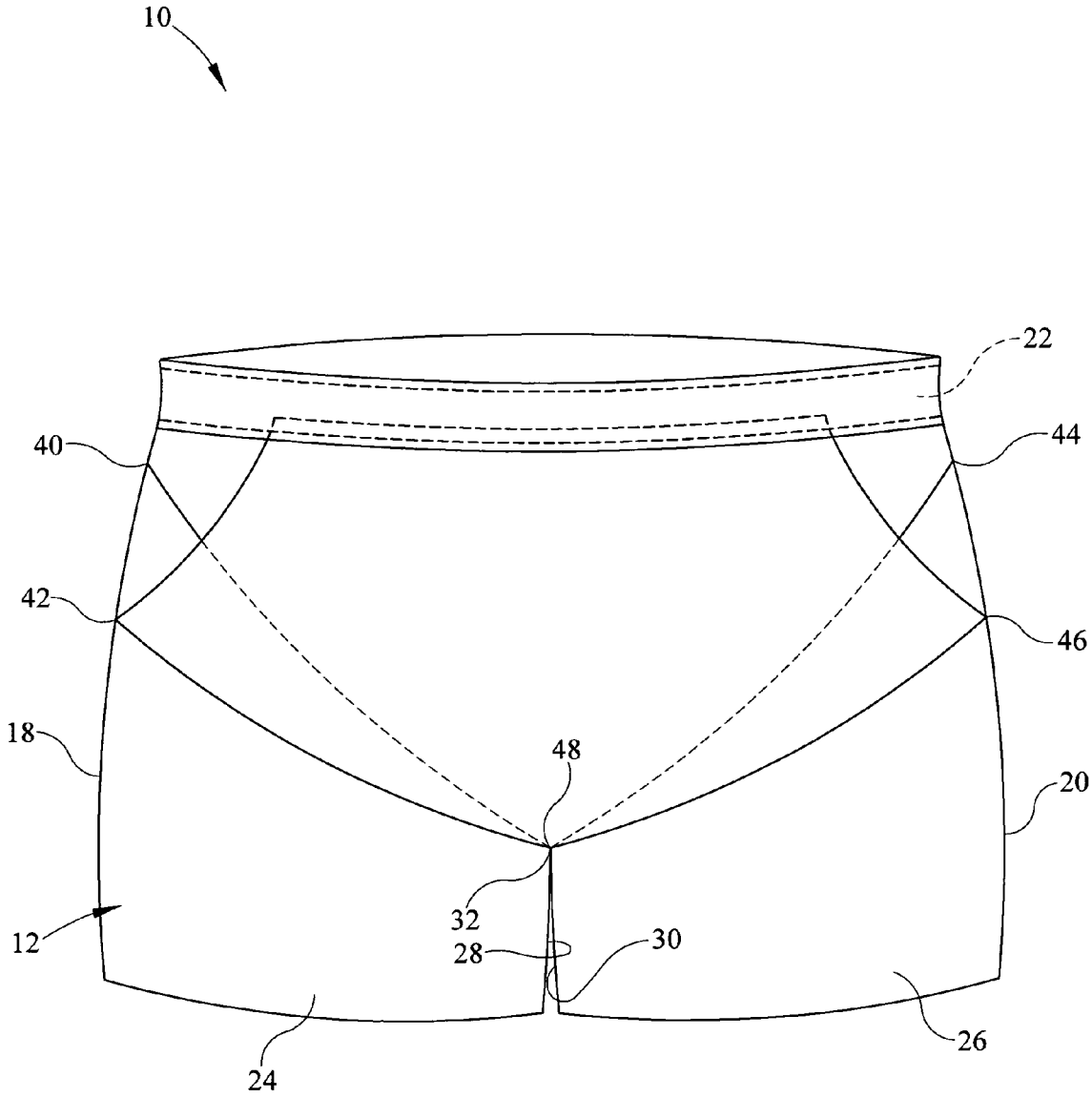
FIG. 4 is a front elevation view of the athletic hammock.

An opening 34 is located on the front panel 14 extending from below the waist band 22 to a position just at or just above the joinder area 32 of the two inseams 28 and 30. The opening 34 is of sufficient size so as to permit the genitals K of the wearer U to comfortably pass without constriction through the opening 34 whenever the athletic hammock 10 is donned. The opening 34 has an inelastic reinforced basting positioned around the opening's perimeter in order to help the opening 34 maintain as constant a size and shape as possible. As is typical of men's shorts, the chassis 12 is generally symmetrical on each half of a midline that passes vertically through the center of the chassis 12 in FIG. 4—the symmetrical nature of the chassis 12 does not account for any pockets, adornments, or other incidentals that may be found on such devices.

The chassis 12 is formed of any material appropriate for men's shorts such as SPANDEX, however, other materials, including cotton, cotton blends, Nylon-polyester blends, etc., can also be used.

The chassis 12 illustrated in the figures is typical of men's shorts, however, the chassis may rise higher or lower on the abdomen of the user U. Likewise the right pant leg 24 and the left pant leg 26 may terminate higher on the user's legs or lower and can even include long johns in keeping within the scope and spirit of the present invention.

A hammock 36, which is a cloth member, has a right top edge 38, an upper right point 40, a lower right point 42, an upper left point 44, a lower left point 46, and a bottom 48. The hammock 36 is attached to the chassis 12 in overlying relationship with the opening 34 of the front panel 14. The hammock 36 is so attached by attaching the top edge 38 to the chassis 12 at the waist band 22, the hammock 36 being made from an asymmetrically weaved cloth, or having darts or pleats or similar manufacturing technique at this edge 38 in order to prevent bunching of any excess material thereat. The right upper point 40 is joined to the chassis at the right out seam 18 just below the waist band 22 while the right lower point 42 is joined to the right out seam 18 below the attachment point of the right upper point 40. Similarly, the left upper point 44 is joined to the chassis 12 at the left out seam 20 just below the waist band 22 while the left lower point 46 is joined to the left out seam 20 below the attachment point of the left upper point 44. The bottom 48 of the hammock 36 is attached to the front panel 14 at the lower edge of the opening 34 just above the joinder area 32. With the hammock 36 attached to the chassis 12, the athletic hammock 10 continues to be generally symmetrical through the above described midline. The hammock 36 again being made from an asymmetrically weaved cloth, or having darts or pleats or similar manufacturing technique at this bottom 48 in order to prevent bunching of any excess material thereat. Attachment of the hammock 36 to the chassis 12 at the various points and edges is by appropriate stitching, which stitching is, advantageously, of a non-stretch variety in order to provide maximum support by the hammock 36. The hammock 36 is made from any appropriate material such as cotton, a cotton polyester blend, etc., and has a non-stretch bias in the transverse direction, that being the direction between the upper right point 40 and lower right point 42 and the upper left point 44 and lower left point 46, again in order for the hammock 36 to give maximum support during use. The perpendicular direction of the hammock 36 has a stretch bias.

In order to use the athletic hammock 10 of the present invention, the chassis 12 is donned by a user U in the usual way of donning a pair of shorts or pants (if the pant legs 24 and 26 are relatively long). The user U positions his genitals K through the opening 34 of the front panel 14 so that the genitals K rest within the hammock 36. The hammock 36 cradles the genitals K and supports then in sling-like fashion both when the user U sits and when he stands. If desired, the hammock 36 may have a fly-type opening (not illustrated) for urination. The athletic hammock 10 is doffed in the usual way.

While the invention has been particularly shown and described with reference to an embodiment thereof, it will be appreciated by those skilled in the art that various changes in form and detail may be made without departing from the spirit and scope of the invention.

I claim:

1. A garment for use by a male; the garment comprising:

a chassis having a front panel and a rear panel joined to the front panel at a right out seam and an opposing left out seam, the chassis having an upper opening and a right pant leg having a right lower opening opposite the upper opening and a left pant leg having a left lower opening opposite the upper opening, the right pant leg having a right inseam opposite the right out seam, and the left pant leg having a left inseam opposite the left out seam and joining the right inseam at a joinder, the front panel having a panel opening;

a waist band encompassing the upper opening; and a hammock attached to an exterior surface of the chassis in overlying relationship with the panel opening, the hammock having an upper edge attached to the waist band, a first right point attached, via stitching, to the right out seam below the waist band, a second right point attached, via stitching, to the right out seam below the first right point, a first left point attached, via stitching, to the left out seam below the waist band, a second left point attached, via stitching, to the left out seam below the first left point, and a bottom attached to the front panel at a lower edge of the opening.

2. The garment as in claim 1 wherein the first right point and the first left point are each located equidistant from the waist band.

3. The garment as in claim 2 wherein the second right point and the second left point are each located equidistant from the waist band.

4. The garment as in claim 1 wherein the hammock has a non-stretch bias in the transverse direction.

5. The garment as in claim 4 wherein the hammock has a stretch bias in a direction that is perpendicular to the transverse direction.

6. The garment as in claim 1 wherein the chassis is formed from a stretch material.

7. The garment as in claim 6 wherein the hammock is made from a cotton blend.

8. The garment as in claim 1 wherein an inelastic reinforced basting is located around an outer periphery of the panel opening.

9. The garment as in claim 1 wherein the waist band is elastic.

10. The garment as in claim 1 wherein the top edge of the hammock has non-bunching means thereat.

11. The garment as in claim 10 wherein the non-bunching means is selected from the group consisting of an asymmetrical weave, darting, and pleating.

12. The garment as in claim 1 wherein the bottom of the hammock has non-bunching means thereat.

13. The garment as in claim 12 wherein the non-bunching means is selected from the group consisting of an asymmetrical weave, darting, and pleating.

14. A garment for use by a male; the garment comprising:

a chassis having a front panel and a rear panel joined to the front panel at a right out seam and an opposing left out seam, the chassis having an upper opening and a right pant leg having a right lower opening opposite the upper opening and a left pant leg having a left lower opening opposite the upper opening, the right pant leg having a right inseam opposite the right out seam, and the left pant leg having a left inseam opposite the left out seam and joining the right inseam at a joinder, the front panel having a panel opening;

a waist band encompassing the upper opening; and a hammock attached to the chassis in overlying relationship with the panel opening, the hammock having an upper edge attached to the waist band, a first right point attached to the right out seam below the waist band, a second right point attached to the right out seam below the first right point, a first left point attached to the left out seam below the waist band, a second left point attached to the left out seam below the first left point, and a bottom attached to the front panel at a lower edge of the opening and wherein the hammock has a non-Stretch bias in the transverse direction.

15. The garment as in claim 14 wherein the hammock has a stretch bias in a direction that is perpendicular to the transverse direction.

16. The garment as in claim 14 wherein an inelastic reinforced basting is located around an outer periphery of the panel opening.

17. The garment as in claim 14 wherein the top edge of the hammock has non-bunching means thereat.

18. The garment as in claim 17 wherein the non-bunching means is selected from the group consisting of an asymmetrical weave, darting, and pleating.

19. A garment for use by a male; the garment comprising:

a chassis having a front panel and a rear panel joined to the front panel at a right out seam and an opposing left out seam, the chassis having an upper opening and a right pant leg having a right lower opening opposite the upper opening and a loft pant leg having a left lower opening opposite the upper opening, the right pant leg having a right inseam opposite the right out seam, and the left pant leg having a left inseam opposite the left out seam and joining the right inseam at a joinder, the front panel having a panel opening;

a waist band encompassing the upper opening; and a hammock attached to the chassis in overlying relationship with the panel opening, the hammock having an upper edge attached to the waist band, a first right point attached to the right out seam below the waist band, a second right point attached to the right out seam below the first right point, a first left point attached to the left out seam below the waist band, a second left point attached to the left out seam below the first left point, and a bottom attached to the front panel at a lower edge of the opening and top edge of the hammock has non-bunching means thereat wherein the non-bunching means is selected from the group consisting of an asymmetrical weave, darting, and pleating.

20. The garment as in claim 19 wherein an inelastic reinforced basting is located around an outer periphery of the panel opening.

* * * * *